US005953873A

United States Patent [19]

Livingston et al.

[11] Patent Number: 5,953,873

[45] Date of Patent: Sep. 21, 1999

[54] MOLDING STRIPS FOR FABRIC WALL AND CEILING SYSTEMS

[75] Inventors: Bryan K. Livingston, Annapolis, Md.; Rob H. Reilly, Alexandria; Harry F. O'Neil, Great Falls, both of Va.

[73] Assignee: Novawall Systems, Inc., Reno, Nev.

[21] Appl. No.: 08/961,097

[22] Filed: Oct. 30, 1997

[51] Int. Cl.[6] ..... E04B 1/00

[52] U.S. Cl. ..... 52/222; 52/716.1; 160/391

[58] Field of Search ..... 52/222, 273, 63, 52/202, 716.1, 716.4, 716.6, 716.7; 160/369, 371, 391, 392, 395

[56] References Cited

U.S. PATENT DOCUMENTS

| | | | |
|---|---|---|---|
| 4,788,806 | 12/1988 | Sease | 52/222 |
| 5,117,598 | 6/1992 | Livingston et al. . | |
| 5,214,892 | 6/1993 | Livingston et al. . | |

FOREIGN PATENT DOCUMENTS

| | | | |
|---|---|---|---|
| 2575243 | 6/1986 | France | 52/222 |

*Primary Examiner*—Creighton Smith
*Attorney, Agent, or Firm*—Whitham, Curtis & Whitham

[57] ABSTRACT

A molding strip for fabric and wall systems has a base for securing it to a wall and a pair of flexible gripping walls facing each other between a fabric entry slot and a fabric receiving cavity. The flexible gripping walls have gripping teeth formed and arranged to encounter the inserted fabric with a front angled surface, with a back surface substantially perpendicular to the direction of fabric entry. The front and back surfaces of the gripping teeth form points projecting into cavities between the gripping teeth on the opposing gripping wall. A one piece fabric panel molding extrusion is "S" shaped and has overlapping alignment regions spaced from the base and may have pre-formed drill starting indentations and apetures. A two piece fabric panel molding includes a mounting base extrusion and a fabric locking extrusion with an interlocking arrangement therebetween. In the two piece fabric panel molding, the mounting base extrusion is secured to a ceiling or wall, and the fabric locking extrusion is then affixed by a simple counter clockwise to clockwise rotational movement.

20 Claims, 5 Drawing Sheets

MOLDING STRIPS FOR FABRIC WALL AND CEILING SYSTEMS

BACKGROUND OF THE INVENTION

1. Field of the Invention

The invention is generally related to stretched fabric panels used for architectural and acoustic interior treatments and, more particularly, to molding strips used to secure the stretched fabric to a support surface such as a ceiling or wall.

2. Description of the Prior Art

Architectural fabric ceiling and wall systems have been used for several years to enhance interior acoustics and the appearance of interior spaces in homes, buildings, rooms, and the like. These systems can provide color, texture, and three-dimensional features to a ceiling or wall which cannot be duplicated by other surface treatments. Typically, these systems include a number of extruded pieces which frame an area over which a fabric is stretched. The extruded pieces are affixed to a support structure such as a wall or ceiling using screws, nails, adhesives, or other securing means as appropriate, and have a retaining mechanism for retaining the fabric. The area which is framed by the extruded pieces can be any shape or size. After the extruded pieces frame the area, the fabric is stretched over the frame and secured in the retaining mechanism. The fabric can be any material which can be held by the retaining mechanism of the extruded pieces. The fabric is often a cloth material, and the cloth may be textured or patterned with a design.

The retaining mechanisms which have been employed in prior art systems typically include a pair of spring biased walls which have opposing jaw members. In operation, the fabric is pushed between the jaws using a knife or other suitable flat object. The fabric accumulates in a cavity between the jaw members, and, if necessary, can be trimmed using a knife or shears at the location of the retaining mechanism after it is inserted into the cavity. Because the extruded members provide a frame for the area of interest, the procedure of stretching the fabric over the frame and stuffing the fabric into the retaining mechanism region of the frame members assures that a smooth fabric surface is presented. The framed unit is often referred to as a stretch fabric "panel".

The fabric panel may be positioned over a tackable core material, such as, for example, in wall applications where it is desired to permit pictures and other objects to be hung on the wall over the fabric panel. In addition, the fabric panel may be positioned over acoustical core materials (i.e., fibrous or foam insulation) which attenuates sound, as would be needed in auditoriums or recording studios. Furthermore, electronic equipment, such as speakers, microphones, and the like, may be positioned behind the fabric panel within a mounting frame or region. The choice of material used for the fabric will depend on the application. In acoustic applications, it will be desirable to use loose weave materials which will allow free passage of air between the room and the sound attenuating foam or fibrous material. This will allow, in the case of embedded speakers, sound to be projected clear and undistorted into the room from the speaker, and, in the case of using acoustical cores to deaden undesirable noise, and will prevent undesirable noise from being reflected into the room. For wall or ceiling applications which are decorative in purpose, fabrics with a tighter weave and other specific characteristics will be preferred.

The panels need not be rectangular in shape. In fact, the edges of several adjacent fabric panels can be organized in a manner which creates parallelograms, triangles, and other geometric shapes on the treated wall surface. In addition, the extruded pieces can be fashioned so as to create bevels, curves, and spaces between adjacent panels.

Several patents describe stretch fabric panel systems. These include U.S. Pat. Nos. 4,631,882, 4,731,960, and 4,788,806 all to Sease; U.S. Pat. Nos. 4,018,260, 4,053,008, 4,151,672, 4,161,977, 4,197,686, and 4,625,490 all to Baslow; and U.S. Pat. Nos. 5,117,598 and 5,214,892 both to Livingston. Each of these patents is herein incorporated by reference.

Despite the widespread use of fabric panel systems, a common problem which has not been adequately addressed is fabric dislodgement from the extruded moldings. If fabric is dislodged during or after installation of the fabric panel, the fabric will have an undesirable, non-smooth finish, and underlying elements such as acoustical cores will become noticeable. In addition, prior art stretch fabric panel systems typically need to be installed by trained personnel and require specialized tools, often which rely on an air compressor or other equipment not readily available to the homeowner or hobbyist that may wish to install the fabric treatments. Accordingly, there is a need for a molding system which can be installed quickly and easily with standard tools, to allow homeowners and hobbyists to take advantage of the architectural and acoustical benefits of stretched fabric panel systems, and which possesses an improved fabric gripping benefit for the homeowner and professional alike.

SUMMARY OF THE INVENTION

An object of the present invention is to provide molding strips for fabric wall and ceiling systems which have a reduced chance for dislodgement of fabric from the moldings which provide the frame for the fabric panel.

It is another object of this invention to provide a one-piece molding strip which can be easily installed, and which provides sufficient rigidity for stretch fabric panel applications.

It is yet another object of this invention to provide a two-piece molding comprising a foundation strip structured for ready installation to a wall surface, and a fabric gripping strip, with means for quickly securing the fabric gripping strip to the foundation strip.

It is still another object of this invention to provide molding strips for fabric wall and ceiling systems which can be installed with commonly available tools.

Pursuant to these and other objects of the present invention, a fabric panel molding has an extrusion extending in a longitudinal direction and a base with a wall contact surface, a fabric receiving cavity, a first and second flexible gripping wall having a first and second gripping surface, respectively. The first and second gripping surfaces are arranged facing each other and extending in the longitudinal direction, parallel to a common plane, and form a fabric entry slot, a fabric gripping region, and a fabric exit into the fabric receiving cavity. Each of the first and second gripping surfaces have a first and a second plurality of gripping teeth, respectively, formed in the fabric gripping region in a lateral spacing between the fabric entry slot and the fabric exit slot into the fabric receiving cavity.

Each of the first and second plurality of gripping teeth are formed of a first tooth grip surface substantially perpendicular to the common plane and of a second tooth grip surface forming an angle with the common plane. The first and second tooth grip surfaces of each of the first and second plurality of gripping teeth form a projecting point extending longitudinally along the extrusion. The first and the second plurality of gripping teeth are arranged such that the point of each of the first plurality of teeth projects into a cavity between a corresponding two of the second plurality of teeth, and vice versa, and so that in the absence of a secured fabric, the teeth may mesh with the point of one tooth contacting a second tooth grip surface in a central region or being positioned only slightly away from the second tooth grip surface.

The first and second flexible gripping walls and the first and second plurality of gripping teeth are structured and arranged such that a fabric inserted into the fabric entry slot first contacts the angled second surface of a first of the first plurality of gripping teeth, passes over the point of the first gripping tooth, which slightly deflects the first gripping wall due to the fabric passing between the point of the first gripping tooth and the second angled surface of a first of the second plurality of teeth. The teeth configuration makes it easier to move fabric into the fabric receiving cavity than to remove the fabric from the fabric receiving cavity, and thereby combats unintended dislodgement of the fabric from the fabric receiving cavity.

In one embodiment of the invention, the fabric panel molding extrusion has a first attachment screw insertion surface spaced a first distance in a first direction normal to the wall contact surface, and a second attachment screw insertion surface spaced a second distance apart from the first surface in the first direction. The first and second screw insertion surfaces are formed with a first and second plurality of pre-formed drilling start indentations, respectively, each of the first indentations being aligned with a corresponding one of the second indentations in a direction normal to the wall attachment surface.

In another embodiment of the invention, a first extrusion has a base and wall mounting surface, and a second extrusion has first and second fabric gripping surfaces as discussed above. The first extrusion is formed for ready attachment of its wall mounting surface to a wall by conventional screws, nails, or other attachment devices. Each of the first and second extrusions include a respective portion of a cooperating quick securing structure for securing the second extrusion to the first extrusion after the first extrusion is attached to a wall.

An example cooperating structure comprises a longitudinal receiving slot and a plurality of first longitudinal locking serrations formed on the first extrusion, and a longitudinal tongue, and a second plurality of longitudinal locking serrations formed on the second extrusion. The longitudinal tongue and the second plurality of longitudinal locking serrations are formed to have cooperative shapes with respect to the longitudinal receiving slot and the first locking serrations. The spacing between the first extrusion's longitudinal receiving slot and first longitudinal locking serrations, and the spacing between the second extrusion's longitudinal tongue and second locking serrations is selected such that the first extrusion is distorted by manually inserting the second extrusion's tongue into the first extrusions receiving slot and engaging the first and second plurality of locking serrations, so that upon release of the manual insertion, the first and second locking serrations are cooperatively locked into one another.

Another example cooperating structure comprises a snap fit configuration wherein one of the first and second extrusions includes longitudinal tongues on opposite sides of the extrusion which interlock with slots, recesses or other receiving areas formed longitudinally on opposite sides of the other extrusion.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
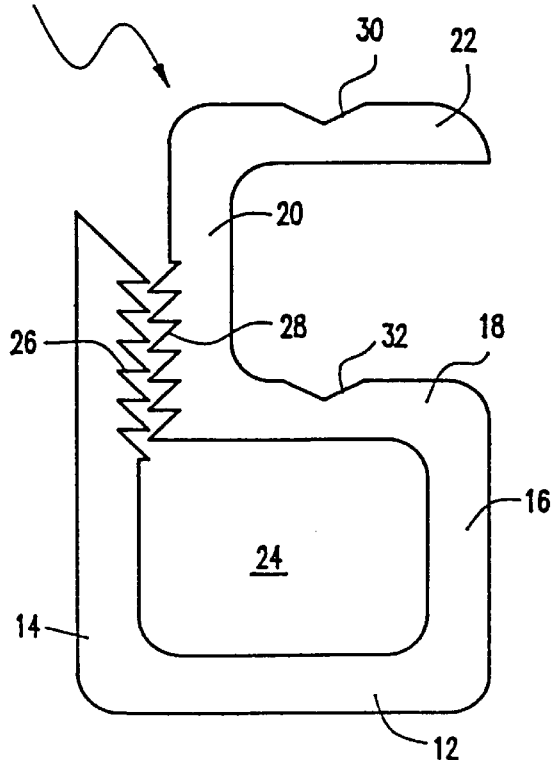
FIG. 1 is a cross-sectional side view of a fabric panel molding according to one embodiment of the invention.

FIG. 1 shows the cross-section of a molding 10 according to one embodiment of the invention. The molding 10 has a base 12, a first flexible wall 14 which extends perpendicularly upward from the base 12, and a second flexible wall which is contoured to have first, second, third, and fourth regions 16, 18, 20, and 22, respectively. A fabric collection cavity 24 is created between the base 12, the first flexible wall 14, the first region 16 and the second region 18 of the second flexible wall. The first flexible wall 14 and the third region 20 of the second flexible wall each have opposing fabric gripping regions 26 and 28 that include a plurality of fabric gripping teeth. As will be discussed in more detail in connection with FIG. 5, it is preferred that the teeth in the fabric gripping regions 26 and 28 have points which are directed towards a central region on an elongated side of teeth on the opposing gripping region; however, alternative teeth arrangements including interdigitated teeth as are shown in U.S. Pat. Nos. 5,117,598 and 5,214,892 to Livingston could also be used on the fabric panel molding 10 embodiment shown in FIG. 1.

Figure 2:
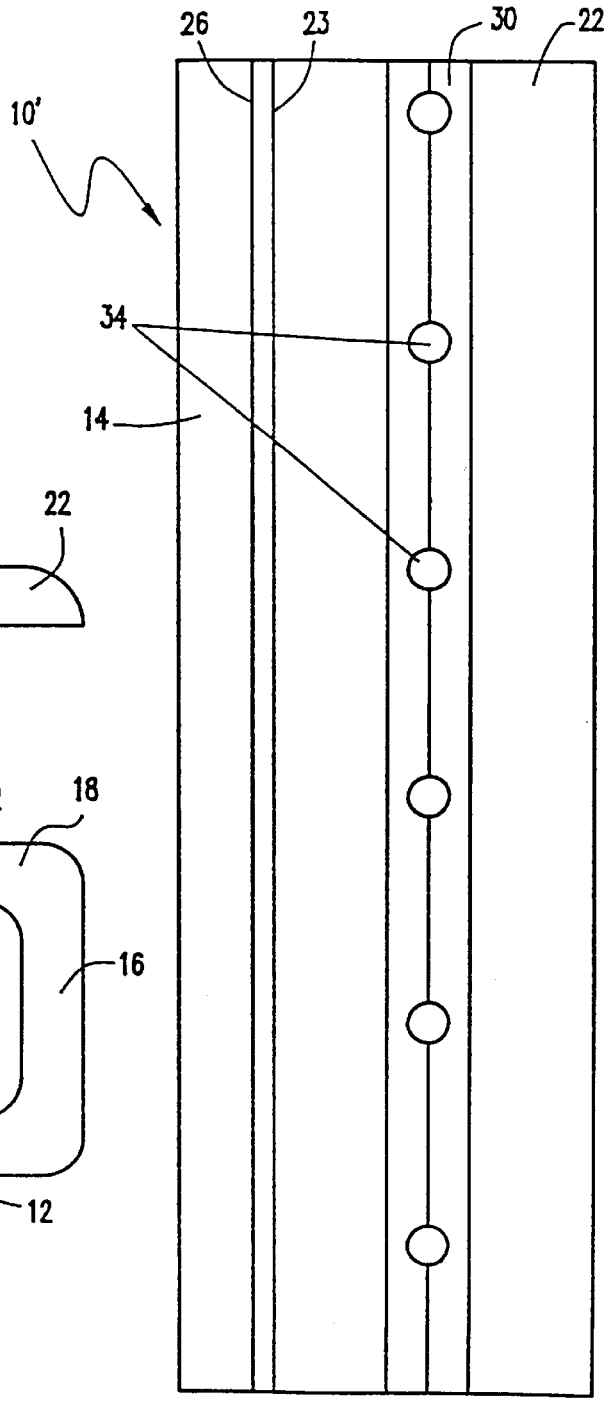
FIG. 2 is a top view of the fabric panel molding shown in FIG. 1.

FIG. 2 shows that the fabric panel molding 10 is an elongated piece. The fabric panel molding 10 will preferably be formed from an extruded plastic such as polyvinylchloride, polypropylene, or polyethylene. The fabric panel molding 10 should be sufficiently rigid that it can be secured to a structure such as an interior wall or ceiling, have fabric stretched over region 22 and be inserted into fabric collection cavity 24 between fabric gripping regions 26 and 28, and hold the stretched fabric at a distance spaced from the base 12 by the height of the second flexible wall without collapsing over time. As discussed above, fabric panels are typically used as surface treatments for walls and ceilings, thus the use generally for an extended period. However, the fabric panel molding 10 must also be flexible and resilient enough to allow the fabric gripping sections 26 and 28 to be moved apart to permit fabric to be stuffed into fabric collection cavity 24, but also allow the fabric gripping sections 26 and 28 to return to their original position which may only be spaced slightly apart or be in contact with one another. That is, there is a spring bias that moves the gripping sections 26 and 28 towards one another after they have been separated to allow fabric to be stuffed into the fabric collection cavity 24. Thus, a wide variety of plastics other than those identified above, as well as other materials, such as spring steel or other metals, which satisfy the demands discussed above can be used to make the molding 10.

FIGS. 1 and 2 show indented regions 30 and 32 in regions 18 and 22 of the fabric panel molding 10. Regions 30 and 32 are in vertical alignment above the base 12 and serve the purpose of providing an alignment region in the molding 10 for access by a screw, nail, or other joining device (not shown). It will be apparent to those of skill in the art that regions 30 and 32 need not be indented; rather, their function is to identify a position for securing a screw through the molding 10 into a wall or ceiling or other substrate surface. The molding 10 is intended to be easily installed by people unskilled in the art such as homeowners or hobbyists, and not require specialized tools or training. In operation, the installer will place the molding 10 against a surface (e.g., a ceiling or wall), position a screw or other fastener in the indented region 30, and then drive the screw or other fastener through the molding 10 out the base 12 into the wall, ceiling or other substrate surface. In the preferred embodiment, the joining member will be a screw which can be driven by a power drill or similar device. It is preferred to use smaller screws for cost and availability considerations. In order to allow easy installation of screws which are longer than region 16 to be used for securing the fabric panel mounting 10 to a wall or ceiling, pilot apertures 34 are formed in region 22 along the length of the fabric panel mounting 10. In operation, a screw will be inserted through an aperture 34 and then driven by a power drill through underlying indented region 32 in region 18 and through base 12 into an underlying substrate surface, and the screw will be sized such that its head is located within indented region 32 after it secures the molding 10 to a wall or ceiling and a sufficient amount of threading on the end of the screw protrudes through the base 12 to provide a solid connection to the underlying wall or ceiling.

Figure 3:
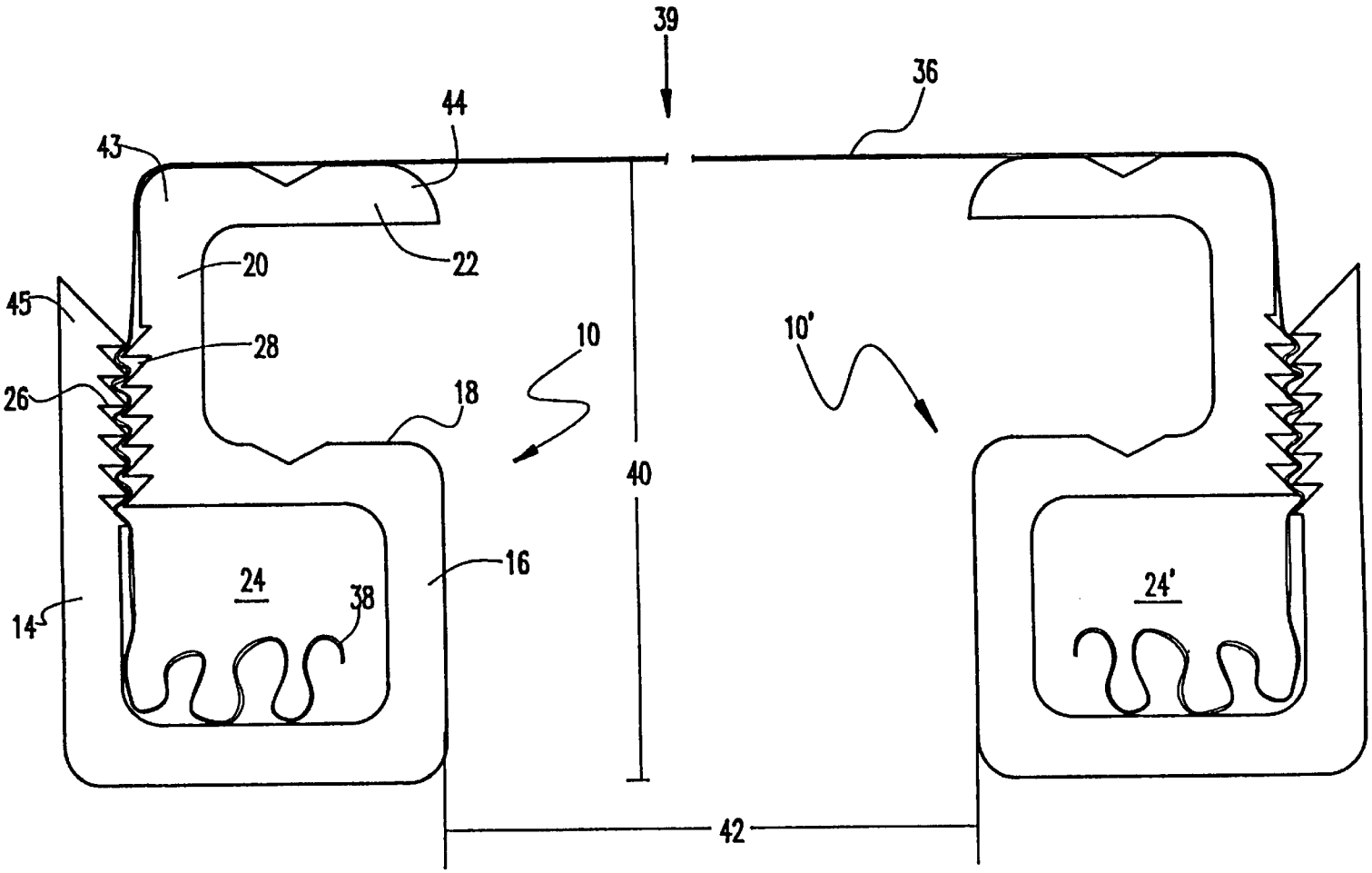
FIG. 3 is a cross-sectional side view of the fabric panel molding shown in FIG. 1, together with a mirror image molding and with a fabric material stretched over both moldings.

FIG. 3 shows a pair of moldings 10 and 10' over which a fabric material 36 is stretched. As discussed above, the fabric material 36 can be any type of material which can be stretched over and securely held by moldings 10 and 10'. The fabric material 36 will typically be a woven cloth, and can be patterned with designs or be of a solid color, and can have rough or smooth texture, depending on the architectural requirements for the space receiving the treatment. In addition, as discussed above, in acoustic treatment applications or in applications where speakers are positioned behind the fabric material 12 it will be desirable to have a fabric material 36 which allows free passage of air to the sound attenuating materials (e.g., fibrous or foam materials). After mounting the fabric panel moldings 10 and 10' on a wall or ceiling, the fabric material 36 is stretched over the top region 22 of each molding 10 or 10', and a loop of fabric is forced down into the fabric collection cavities 24 or 24' using a bladed tool which can push the loop between the fabric gripping sections 26 and 28. The end of the loop can then be trimmed with a razor or shears, and stuffed into the fabric collection cavity 24 or 24' using the bladed tool such that the fabric 36 neatly collects within and terminates 38 inside the fabric collection cavity 24 or 24', thereby providing a neat, finished appearance for the fabric panel when viewed in the direction indicated by arrow 39.

The fabric material 36 is tightly held by the teeth in gripping sections 26 and 28. As will be discussed in connection with FIG. 4, the preferred tooth design requires the fabric material to assume a bunched up configuration which more firmly holds the fabric material than straight walled gripping members or the serpentine pattern which results from interdigitated teeth. In the preferred embodiment, the fabric material 36 is held firmly between a tooth on one gripping surface 26 or 28, and a central region on a downward sloping side of a tooth on the opposing gripping surface 26 or 28. The downward oriented, barbed tooth arrangement (as opposed to interdigitated teeth) allows the fabric material 36 to be inserted into the fabric collection cavity 24 or 24' more easily than it can be withdrawn from the cavity. The design more effectively reduces or eliminates fabric dislodgement from the fabric collection cavity 24 and 24', than alternative prior art fabric gripping designs for fabric panel moldings. While the teeth on one gripping section 26 or 28 can contact the downward sloping side or "long" side of teeth on a the opposing gripping surface, this is not required to practice the invention. Rather, all that is required is to have the downward pointing tooth or "barbed tooth" be directed towards and closely spaced from a central region of the long side of a tooth on the opposing gripping surface such that the fabric 36 can be tightly held between the point of a tooth on one gripping surface and the long side of a tooth on the opposing gripping surface. Providing the molding with a slight gap between the point of the tooth and the long side of the opposing tooth may allow for easier stuffing of fabric material into fabric collection cavity 24 or 24'.

The size of the fabric panel moldings 24 and 24' establishes the spacing 40 of the fabric material 36 from the surface on which the moldings 25 are mounted. The size of the fabric panel moldings 24 and 24' can be varied considerably within the practice of the present invention, and will depend on the installation site, and other requirements such as the type of material which will be positioned between the fabric material 36 and the surface (e.g., ceiling or wall). Fabric panel moldings 24 and 24' may be 1" to 2" in height for most architectural and acoustic applications; however, smaller and larger moldings may be desired for certain applications. Ideally, region 22 will be located an equal distance or larger from the surface of the ceiling or wall as the thickness of the tacking core, acoustical core, electronic components (e.g., speakers), or other materials which will be positioned between the ceiling or wall and the fabric material 36. The distance 42 between the fabric panel moldings 10 and 10' can vary greatly and will depend on the needs of the installer, the architectural effect to be achieved, the core material to be positioned under the fabric material 36, and on a variety of other reasons. Thus, the distance 42 can be a few inches or smaller or a few feet or larger.

In stretch fabric panel applications it is desirable to achieve a smooth flat finish from the perspective indicated by arrow 39. To this end, it is preferred that region 22 project outward from region 20 approximately to the outside edge of region 16. In this way a core material (not shown) which will be positioned between fabric material 36 and the ceiling or wall will abut against region 16 and region 22. This will prevent a void or "dead space" between the core material and the fabric panel mounting 10 from being discerned by a person looking at the panel in the direction of arrow 39. While the edges 43 and 44 of region 22 are rounded, it should be apparent that they can be squared off or beveled, depending on the architectural presentation desired.

In addition, while FIG. 3 shows region 22 projecting from the top of region 20, region 22 may project from a point below the top of region 20 in certain applications. In addition, while flexible wall 14 has an angled top end 45, it will be understood that this top end 45 could have a flange similar to region 22, or be rounded or beveled depending on the architectural effect desired.

Figure 4:
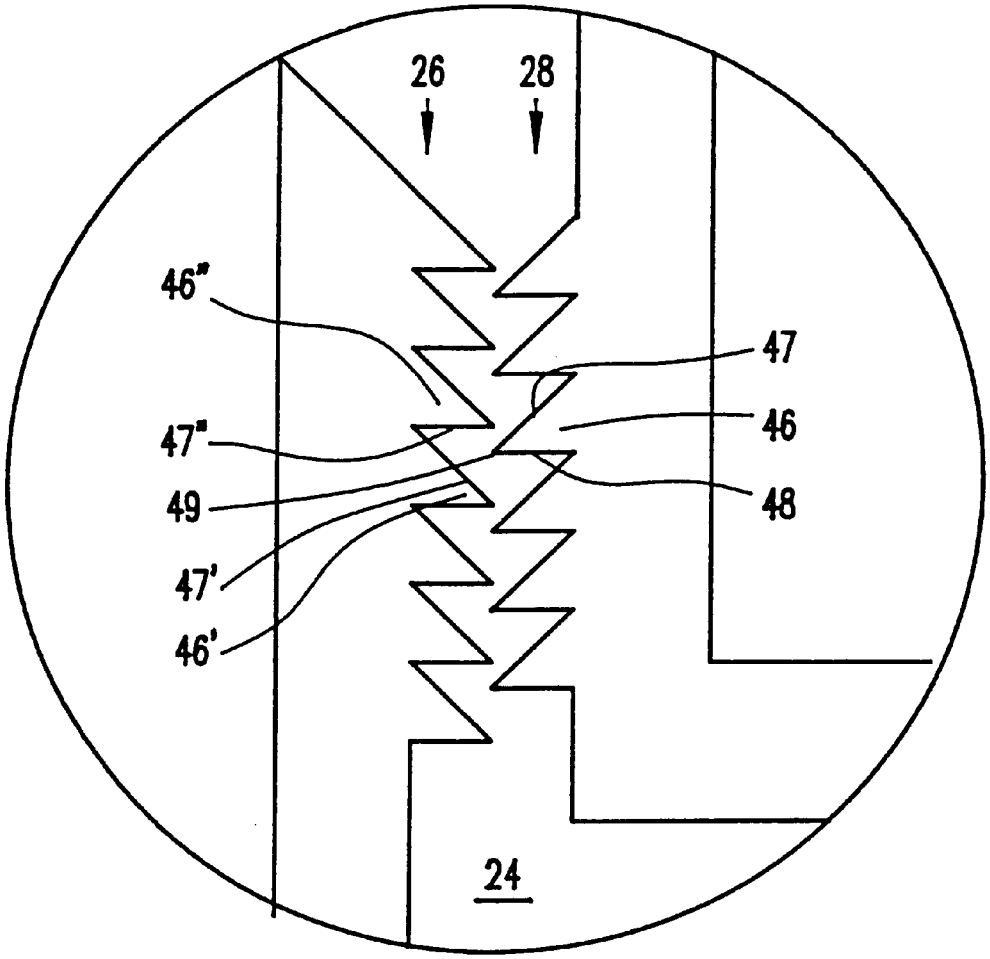
FIG. 4 an exploded cross-sectional side view of fabric gripping teeth used on fabric panel moldings according to a preferred embodiment of this invention.

Returning to FIG. 4, there is shown opposing gripping sections 26 and 28 with a preferred configuration for the gripping teeth. Each tooth 46 has a long side 47 and a short side 48. The short side 48 projects approximately perpendicular or normal to the gripping section 26 or 28, such that the point 49 of the tooth 46 is directed downward and is closer to the fabric collecting cavity 24 than the base of the long side 47. As discussed in connection with FIG. 3 the point 49 is directed towards a central region of the long side 47' of an opposing tooth 46' and serves to trap and retain fabric (not shown) between the point 49 and the long side 47'. In some applications it may be desirable to have the point 49 contact the long side 47'; however, having a small gap which is preferably smaller than the fabric to be inserted into fabric collection cavity 24 may provide for ease in stuffing the fabric into the cavity 24 between gripping sections 26 and 28. Fabric retention can be enhanced by having a relatively sharp point 49, as is shown in FIG. 4. However, the pressure fit between the point 49 and long side 47' is responsible for resistance to fabric dislodgement from cavity 24; therefore, having rounded or squared off points can also provide advantages within the practice of this invention. In the preferred embodiment, the angle created by the long side 47 and short side 48 of the tooth 46 (or by planes passing through the long side 47 and short side 48 of the tooth 46) ranges between 35° and 55°, and is most preferably 45°. This provides for the creation of a small gap or cavity between the point 49 of tooth 46 and the short side 47" of tooth 46" in which fabric material can bunch up and be securely held.

Figure 5:
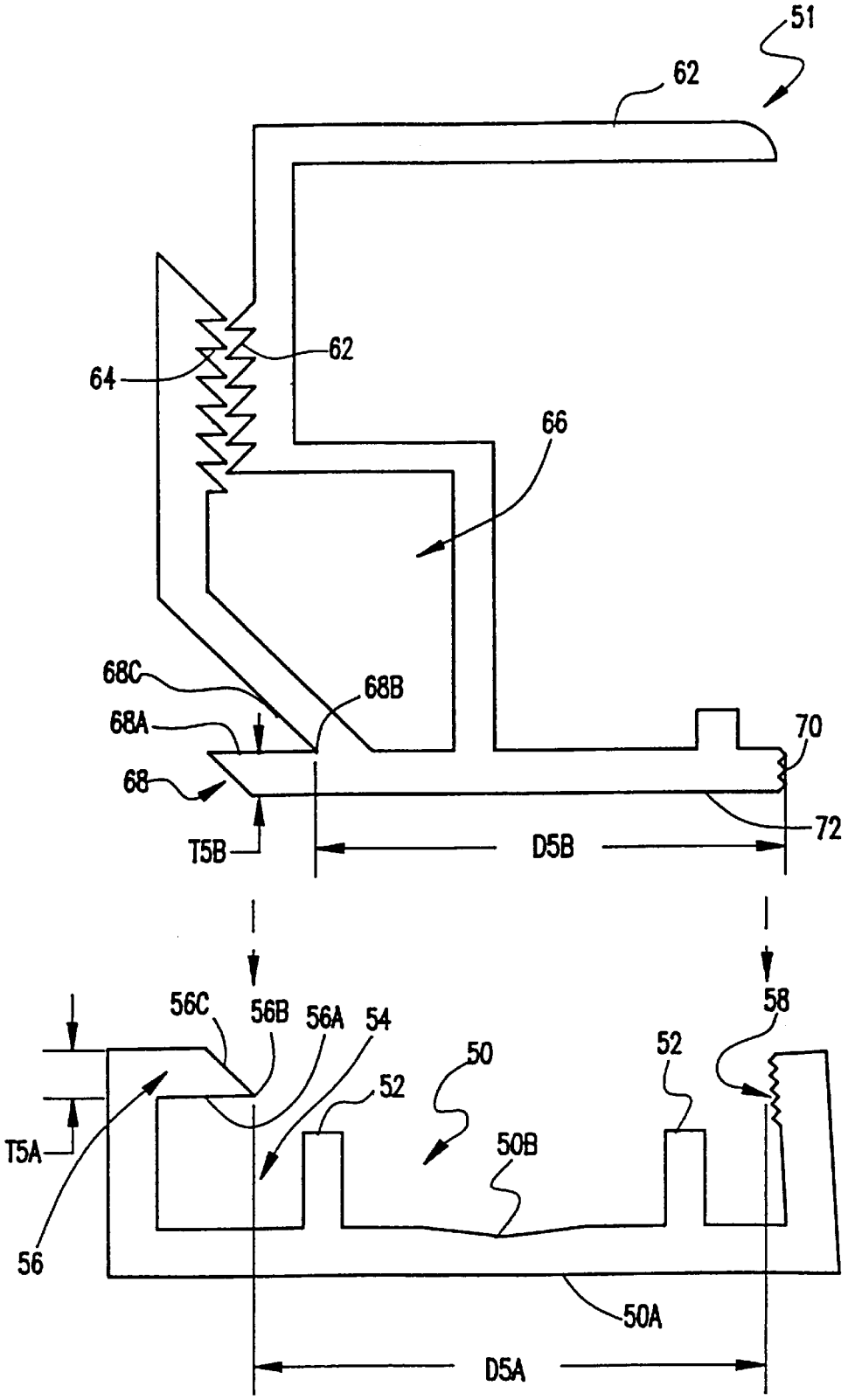
FIG. 5 is a cross-sectional side view of a fabric panel molding according to a second embodiment of the invention.

FIG. 5 shows a further embodiment of this invention having a two-piece structure, which offers an alternative mounting technique and further adaptability for some applications. As depicted, this embodiment comprises a base rail 50 and a fabric gripping rail 51. The base rail 50 alone is preferably mounted first, with its surface 50*a* to the wall (not shown) by screws or other fasteners through the indentations 50*b*, which serve the same purpose as the indentation of 32 of the previous embodiment. The base rail 50 has supports 52, and a slot 54 having at its upper surface a projection 56 forming a securing surface 56*a*, an abutment point 56*b* and an abutment face 56*c*. The dimension T5A between the securing surface 56*a* and the support surface 52 can be substantially equal to the thickness T5B of the fabric gripping rail 51, as is shown in FIG. 5, however, it should be understood that these dimensions may be changed to meet other design requirements. Located a distance D5A from the abutment point 56*b* is a first locking serrated surface 58. The distance D5A is slightly smaller than the dimension D5B of the fabric gripping rail, for reasons which will be apparent from the description below.

The fabric gripping rail 51 has first gripping teeth 62 and second gripping teeth 64 for guiding a fabric into the fabric receiving cavity 66 and for gripping the fabric against pull-out. Either before or after the fabric has been pushed though the teeth 62 and 64, the fabric gripping rail 51 is aligned with the base rail 50, the projection 68 is inserted into the base rail slot 54, and the rail 51 is pushed back until its surfaces 68*b* and 68*c* abut the base rail 50 abutment surfaces 56*b* and 56*c*, respectively. Then the fabric gripping rail 51 is pushed down so that its serrated surface 70 contacts the rail 50 serrated surface 58, which slightly spreads the rail 50 in the direction of the dimension D5A. The fabric gripping rail is then pushed down further until its bottom surface 70 contacts the supports 52 of the rail 50. The serrations 58 and 70 are respectively formed, and the dimensions D5A and D5B are selected such that the rail 50 returns to approximately its nominal dimension D5A when the serrations 58 and 70 are fully engaged with one another and the surfaces 52 and 72 are in contact.

The gripping teeth 62 and 64 for the FIG. 5 depicted example are identical to the gripping teeth 26 and 28 of FIG. 1. However, interdigitated teeth (not shown) can be substituted. Surface 74 serves a role similar to region 22 shown in FIG. 1.

Figure 6:
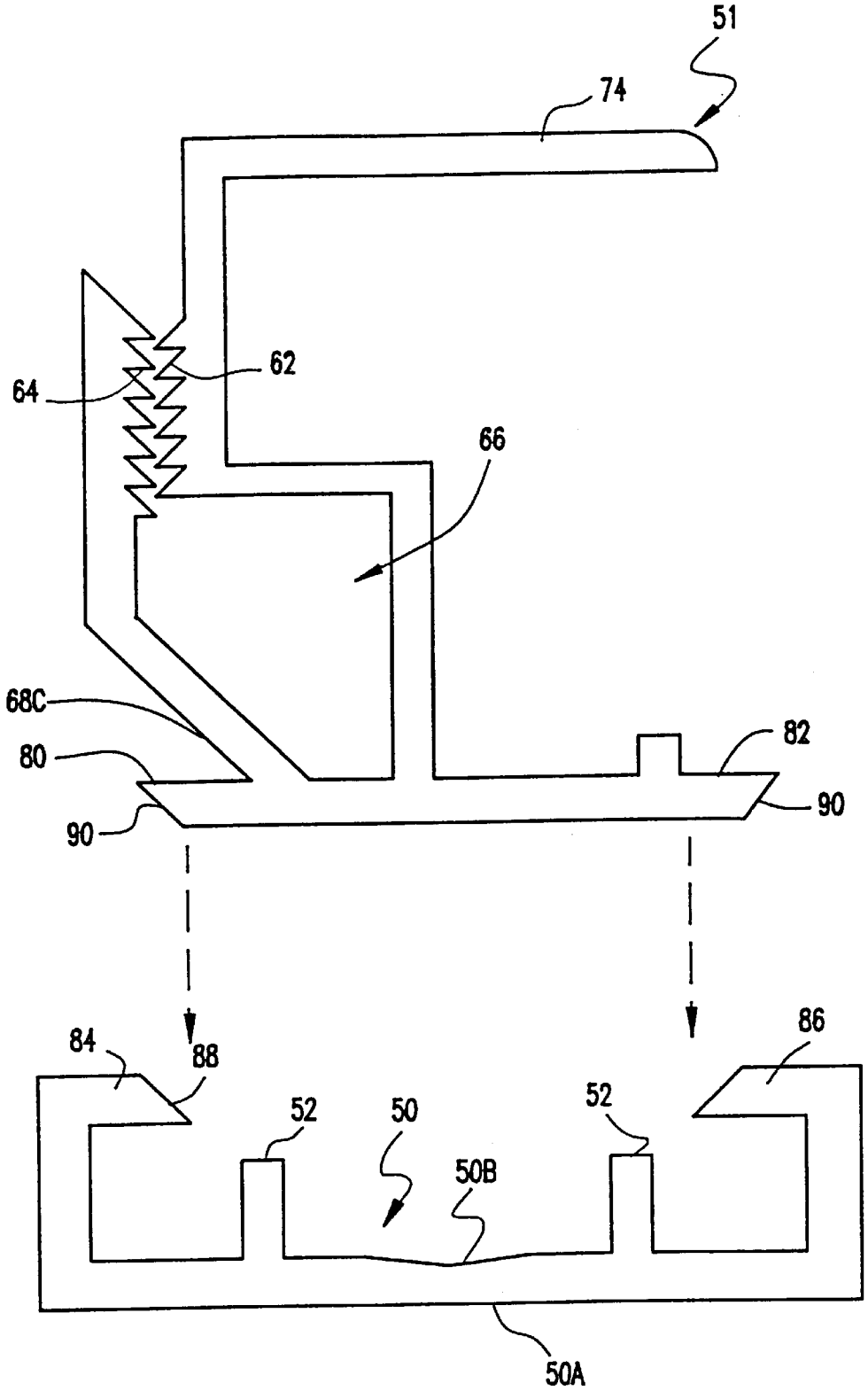
FIG. 6 is cross-sectional side view of the fabric panel molding similar to that shown in FIG. 5 showing an alternative, snap-fit cooperating structure between the two extrusions.

FIG. 6 shows a preferred embodiment for the two-piece extrusion similar to that shown in FIG. 5, and like numbers in each figure denote like elements. Rather than the clockwise rotational fit with serration intermeshing between base rail 50 and fabric gripping rail 51 shown in FIG. 5, FIG. 6 shows a two piece structure where the fabric gripping rail 51 is snap fit into the base rail 50. This is accomplished by having the fabric gripping rail 51 have two tongue projections 80 and 82 on opposite sides which fit under cantileavered projections 84 and 86 on the base rail 50. As discussed above, the base rail 50 and fabric engaging rail 51 are extruded; thus, the tongue projections 80 and 82, and cantileavered projections 84 and 86 run longitudinally the length of the rail. The edges 88 and 90 of the tongue projections 80 and 82 and cantileavered projections 84 and 86 can be angled in a complimentary fashion so as to allow the instraller to more easily center the fabric gripping rail 51 over the base rail 50 and then push the fabric gripping rail 51 into the base rail 50. The pushing action causes the cantileavered projections 84 and 86 to temporarily flex apart. Once the tongue projections 80 and 82 are located under the cantileavered projections 84 and 86, the cantileavered projections return to the original position and overlap the top portions of the tongue projections 80 and 82 to hold them firmly in place, thereby affixing the fabric engaging rail 51 to the base rail 50. While the above description contemplates pushing the fabric engaging rail 51 straight into the base rail 50, the installation may proceed by a counterclockwise followed by a clockwise turning motion (or the reverse) as described above. In this way, only one tongue projection 80 or 82 would need to be forced under one of the cantileavered projection 84 and 86.

While the invention has been described in terms of its preferred embodiments, those skilled in the art will recognize that the invention can be practiced with modification within the spirit and scope of the appended claims.

We claim:

1. A molding for a fabric panel, comprising:

a base;

first and second flexible walls extending from said base, said first and second flexible walls each having gripping sections spaced away from said base by non-gripping sections wherein a first gripping section on said first flexible wall is positioned adjacent a second gripping section on said second flexible wall and wherein a first non-gripping section on said first flexible wall is spaced away from a second non-gripping section on said second flexible wall whereby a fabric collection cavity is defined by said base said first and second non-gripping sections of said first and second flexible walls and said first and second gripping sections of said first and second flexible walls, at least one of said first and second flexible walls being movable to a position which allows a fabric material to pass between said first and second gripping sections of said first and second flexible walls into said fabric collection cavity; and first and second fabric gripping teeth respectively positioned on said first and second fabric gripping sections, each of said first and second fabric gripping teeth having a long side and a short side where said long side is relatively further away from said fabric collection cavity than said short side and wherein said short side projects from one of said first and second gripping sections approximately perpendicular to said gripping section whereby a point of each tooth is generally oriented closer to said fabric collection cavity than a base of a long side of said tooth, and wherein said point of each tooth in one of said first and second gripping sections is directed towards a central region of a long side of an opposing tooth in another of said first and second gripping sections.

2. The molding of claim 1 wherein said short side and said long side of each tooth in said first and second fabric gripping teeth form an angle at said point which ranges from 35 to 55 degrees.

3. The molding of claim 2 wherein said angle is approximately 45 degrees.

4. The molding of claim 1 wherein said first and second flexible walls are integral with said base.

5. The molding of claim 1 wherein said point of each tooth in said one of said first and second gripping sections contacts said central region of said opposing tooth in said another of said first and second gripping sections when said one of said first and second flexible walls is not in said position which allows said fabric between said first and second gripping sections.

6. The molding of claim 1 wherein said first and second fabric gripping teeth permit relatively easier access of said fabric into said fabric collection cavity between said first and second gripping sections than fabric emanating out of said fabric collection cavity.

7. The molding of claim 1 further comprising a flange member extending from at least one of said first and second gripping sections.

8. The molding of claim 1 wherein said base is approximately equivalent in width to said fabric collection cavity.

9. The molding of claim 1 further comprising a substrate mounting structure for receiving said base.

10. The molding of claim 9 wherein said substrate mounting structure includes mechanical connectors positioned on first and second sides for joining to first and second sides of said base.

11. A molding for a fabric panel, comprising:

a base having length and width dimensions;

a first flexible wall which extends generally perpendicular to said base from a first position in said width dimension of said base and which spans approximately the entire length dimension of said base;

a first fabric gripping section positioned on said first flexible wall at a position spaced away from said base; and a second flexible wall which extends from said base and substantially spans approximately the entire length dimension of said base, said second flexible wall being contoured to have i) a first region which extends generally perpendicular to said base from a second position in said width dimension of said base wherein said first and second width dimensions of said base are spaced apart on said base, ii) a second region which extends from said first region generally parallel to said base and towards said first flexible wall, said second region having a first alignment region on a surface of said second region facing away from said base for receiving a joining member used to join the molding to a structure, iii) a third region which extends from said second region generally perpendicular to and away from said base, said third region comprising a second fabric gripping section which is adjacent to and opposes said first fabric gripping section on said first flexible wall, whereby said base said first flexible wall said first and second regions of said second flexible wall and said first and second fabric gripping sections define a fabric collection cavity, and iv) a fourth region which extends from said third region generally parallel to said second region and spaced away from said second region by said third region, said fourth region including a second alignment region on a surface of said fourth region facing away from said base for receiving said joining member, said first alignment region in said second region and said second alignment region in said fourth region being vertically aligned with respect to said base.

12. The molding of claim 11 further comprising a plurality of apertures formed in said second alignment region.

13. The molding of claim 11 wherein said first and second positions in said width dimension of said base are respectively located at first and second sides of said base and said width dimension of said base is entirely within said first and second positions.

14. The molding of claim 11 wherein said first and second fabric gripping sections respectively include first and second fabric gripping teeth, each of said first and second fabric gripping teeth having a long side and a short side where said long side is relatively further away from said fabric collection cavity than said short side and wherein said short side projects from one of said first and second gripping sections approximately perpendicular to said gripping section whereby a point of each tooth is generally oriented closer to said fabric collection cavity than a base of a long side of said tooth, and wherein said point of each tooth in one of said first and second gripping sections is directed towards a central region of a long side of an opposing tooth in another of said first and second gripping sections.

15. The molding of claim 14 wherein said short side and said long side of each tooth in said first and second fabric gripping teeth form an angle at said point of approximately 45 degrees.

16. The molding of claim 11 wherein said fourth region of said second flexible wall extends to an end which is perpendicularly in alignment with a side of said base.

17. The molding of claim 11 wherein said first and second alignment regions are indented in said second flexible wall.

18. A molding assembly for securing a fabric panel, comprising:

a fabric gripping rail member having a gripping rail base extending a length dimension in a longitudinal direction and having a first engagement portion extending in the longitudinal direction and a second engagement portion extending parallel to, and displaced a first distance in a width direction perpendicular to the longitudinal direction from, the first engagement portion;

a fabric collection cavity structure formed integral with said gripping rail base and having a fabric collection cavity extending in said longitudinal direction;

a first flexible wall extending outwardly from said fabric collection cavity structure generally perpendicular to said longitudinal direction and spanning approximately the entire length dimension of said gripping rail base;

a first fabric gripping structure positioned on said first flexible wall;

a second flexible wall extending parallel to said first flexible wall;

a second fabric gripping section positioned on said second flexible wall and facing said first fabric gripping section, wherein said first and second gripping sections and said first and second flexible walls form a compression type gripping structure extending in said longitudinal direction and in a direction perpendicular to said longitudinal direction from a fabric entry slot formed by a longitudinal portion of said first and second flexible gripping walls distal from said fabric gripping rail to a longitudinal portion of said first and second flexible gripping walls proximal to said fabric collection cavity; and a base rail member having a surface for contacting a wall and securing means for cooperatively engaging said first engagement portion and said second engagement portion of said fabric gripping rail member to said base rail member.

19. The molding assembly of claim 18 wherein said first and second fabric gripping sections respectively include first and second fabric gripping teeth, each of said first and second fabric gripping teeth having a long side and a short side where said long side is relatively further away from said fabric collection cavity than said short side and wherein said short side projects from one of said first and second gripping sections approximately perpendicular to said gripping section whereby a point of each tooth is generally oriented closer to said fabric collection cavity than a base of a long side of said tooth, and wherein said point of each tooth in one of said first and second gripping sections is directed towards a central region of a long side of an opposing tooth in another of said first and second gripping sections.

20. The molding assembly of claim 18 wherein at least one of said first and second engagement portions on said gripping rail base includes a tongue extension, and said securing means includes a cantilevered member for retaining said tongue extension.

* * * * *